United States Patent [19]

Kahler

[11] Patent Number: 4,911,344

[45] Date of Patent: Mar. 27, 1990

[54] STRIP DISPENSER BOX

[75] Inventor: William F. Kahler, Johns Island, S.C.

[73] Assignee: Tek-Aids Inc., Charleston, S.C.

[21] Appl. No.: 172,203

[22] Filed: Mar. 23, 1988

[51] Int. Cl.[4] ..... B65D 83/08

[52] U.S. Cl. ..... 221/135; 221/232; 221/267

[58] Field of Search ..... 221/228, 232, 247, 250, 221/259, 135, 267; 206/204, 569, 39.4, 565, 560, 355, 356

[56] References Cited

U.S. PATENT DOCUMENTS

| | | | |
|---|---|---|---|
| 717,983 | 1/1903 | Fulton | 221/267 X |
| 934,386 | 9/1909 | Blekastad | 221/228 |
| 1,598,266 | 8/1926 | Davis | 221/259 X |
| 2,502,248 | 3/1950 | Colton et al. | 221/232 X |
| 2,889,076 | 6/1959 | Van Schie | 221/232 |
| 2,973,882 | 3/1961 | Jeffus | 221/228 |
| 3,151,738 | 10/1964 | Stone | 206/204 |
| 3,393,831 | 7/1968 | Stewart | 221/259 X |
| 4,717,018 | 1/1988 | Sacherer et al. | 206/569 X |

FOREIGN PATENT DOCUMENTS

| | | | |
|---|---|---|---|
| 872257 | 6/1942 | France | 221/228 |

*Primary Examiner*—F. J. Bartuska

*Attorney, Agent, or Firm*—Gipple & Hale

[57] ABSTRACT

A disposable strip dispenser for dispensing a single testing strip from a stack of testing strips is constructed with a housing and integrally formed magazine to hold a stack of testing strips. A cap assembly with a strip feeder mechanism is mounted to the housing to form a water proof chamber. The cap assembly is locked to the housing with a rib and channel locking assembly with the body of the cap assembly defining a slot and slide bar assembly slideably mounted in the slot. The slide bar assembly comprises a strip guide bar with a finger grip mount extending from the guide bar through the slot with the bottom of the guide bar engaging the topmost strip on a spring biased stack of strips allowing a single strip to be dispensed from the housing through an aperture defined in the cap assembly while maintaining the remaining strips of the stack of testing strips in a moisture free environment.

6 Claims, 2 Drawing Sheets

FIG. 1
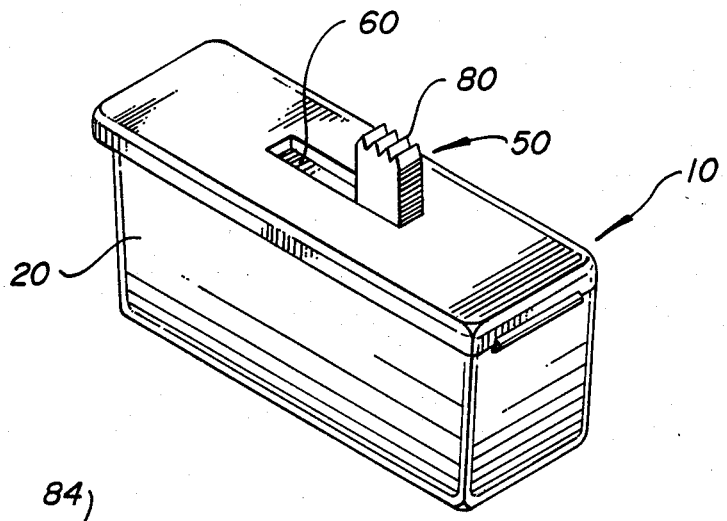
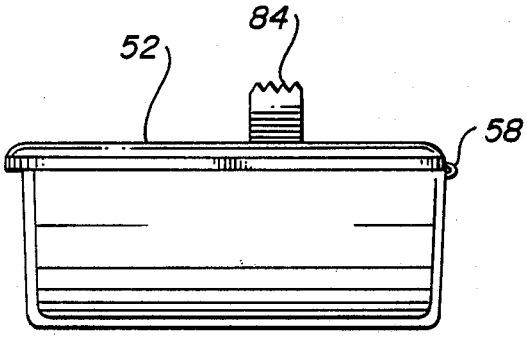
FIG. 2
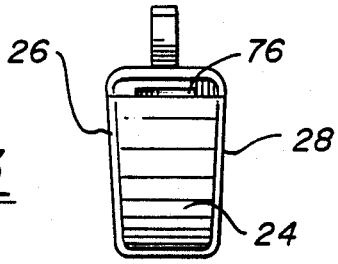
FIG. 3
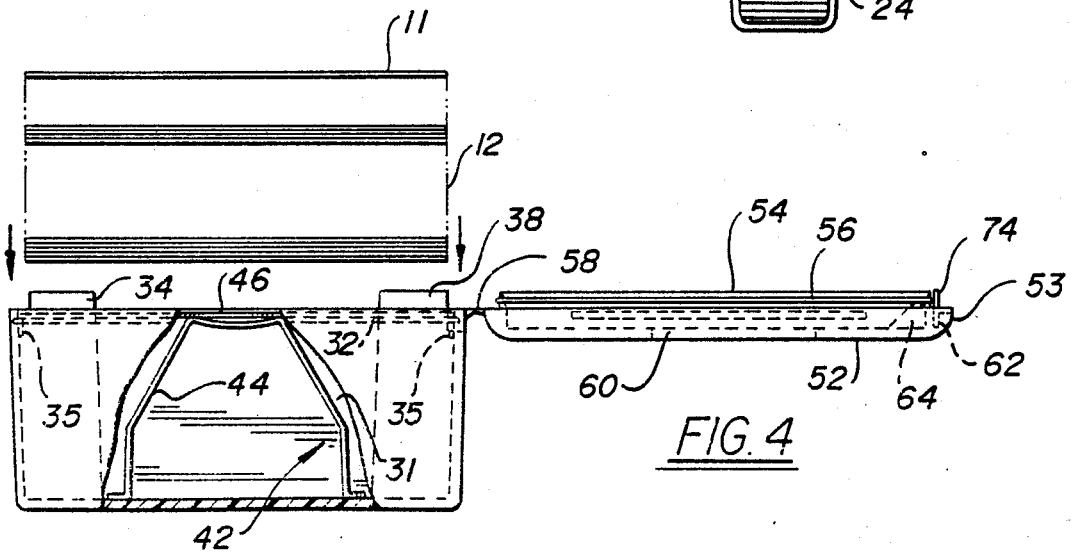
FIG. 4

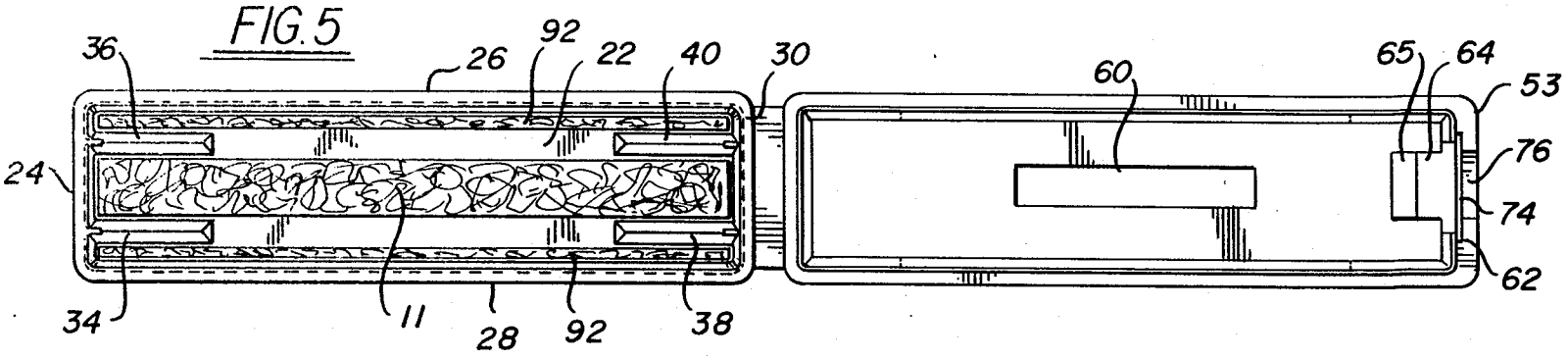
FIG. 5
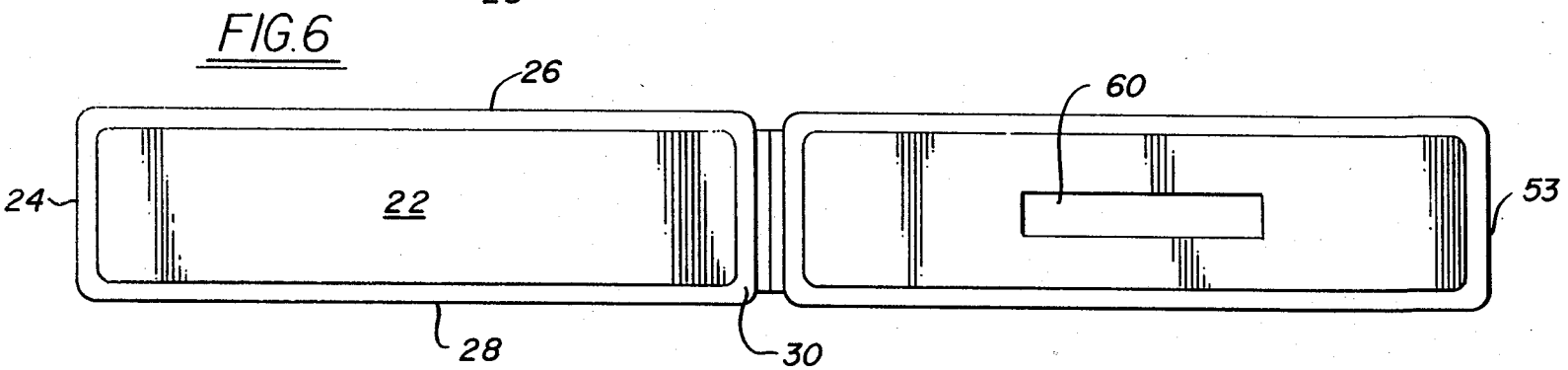
FIG. 6
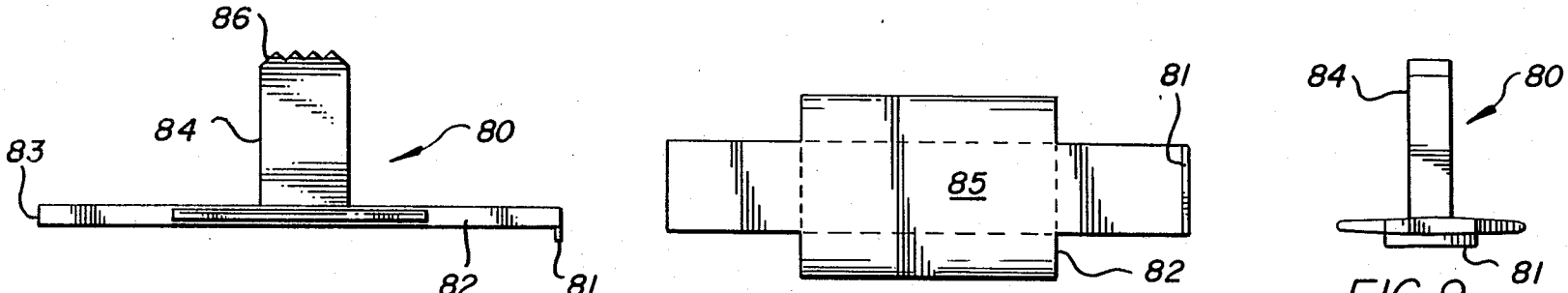
FIG. 9
FIG. 8
FIG. 7

STRIP DISPENSER BOX

BRIEF DESCRIPTION OF THE INVENTION

There presently exists a need for a simple disposable diagnostic test strip dispensing apparatus which is inexpensive and keeps the test strips in a dry, unhandled environment. Presently, test strips are dispensed for use with patients from bulk supply containers and reusable container and consequently, are subject to contamination from the natural acids and oils present on human fingers as well as the normal spillage of chemicals and fluids which occur in hospitals and other areas. In addition to the noted problems, the reagent strips often encounter moisture before they are used causing them to not record satisfactorily or to record inaccurately.

SUMMARY OF THE INVENTION

The present invention is directed toward a sealed disposable diagnostic strip container which is easily adapted to dispense diagnostic testing strips, one at a time, so that the strips can be self-administered or administered by a medical professional or non-professional. Strips when used for diagnostic testing are read and then thrown away into a receptacle. The invention is directed towards a disposable, sealed container having a thumb activated feeding mechanism which engages the top strip of a stack of strips which is urged upward and propels a single strip through an aperture in the container. A gasket piece seals the container aperture before and after the strip has been dispensed.

Thus the object of the invention to keep a stack of diagnostic testing strips held in a magazine in a dry isolated condition so that the strips will not be contaminated by outside sources such as humidity, atmospheric conditions or other reagents which could cause the testing strips to become chemically imbalanced so that they do not perform an accurate testing.

Another object of the invention is to provide an inexpensive disposable one piece plastic container which can be injection molded and mass produced.

Other objects, features and advantages of the invention will become apparent in the following description thereof, taken in conjunction with the accompanying drawings which form part of the specification.

BRIEF DESCRIPTION OF THE DRAWINGS

FIG. 1 is perspective view of the strip dispensing apparatus;

FIG. 2 is a side elevational view of the invention shown in FIG. 1;

FIG. 3 is a front elevational view of the invention as shown in FIG. 1;

FIG. 4 is an enlarged side elevational view of the invention shown in FIG. 1 with the cap feeder mechanism lifted off the strip container and strips shown in exploded view;

FIG. 5 is an enlarged top plan view of the invention shown in FIG. 4;

FIG. 6 is a bottom plan view of of the invention shown in FIG. 5;

FIG. 7 is a side elevational view of the strip pusher assembly of the invention;

FIG. 8 is a bottom plan view of the strip pusher assembly shown in FIG. 8; and FIG. 9 is a front elevational view of the strip pusher assembly shown in FIG. 7.

DETAILED DESCRIPTION OF THE INVENTION

The preferred mode and best embodiment of the invention is shown in FIGS. 1 through 9 above. As is illustrated by the figures, the numeral 10 designates the strip dispenser apparatus with numeral 20 being directed towards the housing of the apparatus and numeral 50 being directed towards the feeder mechanism of the apparatus.

The housing 20 as best shown in FIGS. 1, 5 and 6 is preferably a rectangular container comprising a base 22 with a front wall 24, side walls 26 and 28 and a rear wall 30. All of the walls extend from the base 22 and form a unitary container which defines a locking groove 32 near the top of the container. Thus the base 22 and walls 24 through 30 define a chamber 31. Two front interior walls 34 and 36 extend from the front wall 22 into the interior area of the chamber 31 and two rear interior walls 38 and 40 extend from the rear wall 30 into the interior of the chamber 31. These interior walls are notched at 35 and are preferably shaped tapering inward with the apex of the wall extending above the height of walls 24, 26, 28 and 30 as is shown in FIG. 4. Thus, a cross section of the interior walls 34, 36, 38 and 40 would appear as a narrow triangle with the base of the triangle defined by the container base 22. The distance between the front interior walls 34 and 36 and the rear interior walls 38 and 40 are such that the distance will be slightly greater than the width of a diagnostic material strip 11.

The diagnostic strips are preferably constructed of mylar and are approximately 1/1000 of an inch thick and contain $TiO_2$ to color it white and thus preclude light transmission or diffusion.

The interior walls 34, 36, 38 and 40 form a magazine to hold a stack 12 of strips 11 and an associated spring means 42 so that the diagnostic strips are urged upward in the chamber 31 for engagement by the feeder mechanism 50. The spring means 42 comprises a U-shaped biasing spring member 44 which urges a strip stack support spring member 46 upward pushing the strips against the feeder mechanism.

The feeder mechanism 50 comprises a cap body 52 having a skirt 54 extending outward from the cap body. A locking rib 56 is formed on the outside of the skirt and is adapted to fit into the annular locking groove 32 of the housing walls to form a sealed chamber which holds a stack 12 of diagnostic tapes. The front edge 53 of the cap body extends past the front wall 24 of the housing approximately 1/64 of an inch. The housing 20 is connected to the feeder mechanism 50 by a flexible hinge member 58 which allows the cap feeder mechanism to be snapped into place onto the housing 20 where it can be alternatively sonically sealed, glued or adhesively attached as is desired to form a unitary construction. The cap body 52 defines a longitudinal slot 60 which is adapted to receive finger strip carrying assembly 80. The cap body also defines a blind slot seat 62 which holds a seal strip or gasket 74 which extends about 1/32 of an inch into the chamber 31 and covers container aperture 76. Adjacent to the blind spot seat 62 and associated gasket 74 is an integrally formed beveled boss 64 which engages the finger slide base member 82 so that the diagnostic strip carried by the bottom surface of the base member is directed through the container aperture 76. Thus, an inclined plane is formed causing the strip 11 to enter the aperture 76 at a correct angle.

The finger strip carrying assembly 80 is mounted in the cap body 52 through slot 60. The finger strip carrying assembly comprises a cross shaped base member 82 slidably positioned on the inner surface of the cap body and a finger grip support member 84 which extends up through slot 60 in the cap body. The finger grip support member 84 has its distal end formed with a serrated edge 86 as shown in Figures 1 and 7. The serrated edge is utilized as a finger grip so that a person's finger can be used to slide the finger carrying assembly along the slot 60. The bottom surface of the base member 82 is provided with a downwardly projection tooth member 81 which engages the end of strip 11 and carries the strip forward through aperture 76. A coating or layer 85 is also placed on the bottom surface of base member 82 which contacts the upper surface of strip 11 to help carry the forward in conjunction with the tooth member 81. The coating can be tacky or the layer roughened as desired. It should be noted that when the finger strip carrying assembly is in its rearward position that there is a space between the front end 83 of the base member 82 and beveled edge 65 of the boss 64. This space allows the spring biased strip 11 to be bowed upward into the space so that it is accurately carried.

In operation, the finger grip support member is driven forward by the action of the thumb of the user and it carries the strip 11 against the door or gasket strip 74 out through aperture 76. The tooth member 81 and the slide guide member coating layer 81 engage the top most strip 11 of the stack 12 held in the magazine and carry the strip forward out of the aperture 76 for use with gasket 74 closing off the dispensing aperture 76 allowing the dispenser to be sealed from the elements.

It should be noted that the preferred material of the integrally made dispenser apparatus 10 is of a close cell polyethylene plastic.

It should also be noted that desiccant paper strips 92 as shown in FIG. 5 are placed on the outside of interior walls 34, 36, 38 and 40 adjacent the side walls 26 and 28 to adsorb any humidity or water out of the air which may exist. In addition, silica gel material could be used in containers held on the side of the magazine. The diagnostic strips 11 preferably have 1/1000 of an inch thickness with one end of the strip to the center being coated with the chromophor which is sensitive to moisture.

It does not matter whether the finger grip support member 84 has been pushed forward toward the front wall 24 for dispensing of the strip 11 or pulled backward to the rear wall 30 for the next cycling of a strip 11 from the magazine holding stack 12 of testing strips. In either position, the aperture 76 is closed by the gasket strip or door 74 so that there is no communication of the inner chamber 31 with the outside atmosphere. Thus, it can be seen that an inexpensive easily working sealed dispensing apparatus is provided by the present invention.

In the foregoing description, the invention has been described with reference to a particular preferred embodiment, although it is to be understood that specific details shown are merely illustrative, and the invention may be carried out in other ways without departing from the true spirit and scope of the following claims:

What is claimed is:

1. A strip dispenser for dispensing a stack of testing strips comprising a housing, magazine means mounted in said housing to hold a stack of testing strips, said housing comprising a base, a plurality of integral side walls, front and rear end walls and magazine means secured to said front and rear end wall, said magazine means comprising a plurality of inner walls extending inward from each end wall of said housing, said inner walls on each end wall being spaced apart a distance greater than the width of a testing strip with the width between the tops of opposing inner walls being greater than the width between the bottoms of the opposing inner walls and linearly aligned with an inner wall extending from the other end wall, feeder means mounted to said housing forming a chamber which is moisture-proof during the strip feeding operation, said feeder means mounted to said housing by hinge means and comprising a cap body defining a slot, said cap body defining a blind seat and gasket means mounted in said blind seat to form seal means sealing a strip exit aperture allowing a single strip to be dispensed from said housing while maintaining the remaining strips of a stack of testing strips in a moisture free environment, and a slide bar assembly slideably mounted in said slot, said slide bar assembly comprising strip engaging means and a finger grip means extending from said strip engaging means through said slot.

2. A disposable strip dispenser for dispensing a single testing strip from a stack of testing strips comprising a plastic walled housing, magazine means integrally formed in said housing to hold a stack of testing strips, said magazine means comprising a plurality of inner walls extending inward from each end wall of said housing and extending above the walls of said housing, two inner walls being positioned adjacent to each end wall, each of said two inner walls being constructed with an inclined side which receives and contains testing strips, spring means mounted in said magazine means to engage said stack of testing strips and urge them outward, cap feeder means mounted to said housing forming a waterproof chamber for said testing strips, said cap feeder means comprising a cap body, means on said cap body to engage said housing and hold said cap body to engage said housing and hold said cap body in a lock relationship with housing, said cap body also defining a slot, a slide bar assembly comprising strip engaging means, a finger grip means extending from said strip engaging means through said slot and means on said cap body allowing a single strip to be dispensed from said housing.

3. A strip dispenser as claimed in claim 2 including desiccant means comprising treated paper strips are mounted in said housing.

4. A strip dispenser as claimed in claim 2 wherein said cap body defines a blind seat and a beveled boss positioned adjacent said blind seat and said blind seat holding gasket means mounted therein to form seal means covering a dispensing aperture defined by said cap body and said beveled boss engaging strip engaging means to direct the strip through an aperture in said housing.

5. A strip dispenser as claimed in claim 2 wherein said cap feeder means is mounted to said housing by flexible hinge means.

6. A disposable strip plastic dispenser for dispensing a single testing strip from a stack of testing strips comprising a housing defining a chamber, magazine means mounted in said housing to hold a stack of testing strips, desiccant means mounted to said housing in said chamber, a cap body removably mounted to said housing to form a moisture proof container, said cap body defining a slot, strip exit aperture means and strip guide means, a slide bar assembly slideably mounted in said slot, said cap body defining a blind seat slot with gasket means mounted in said blind seat slot to form seal means sealing said strip exit aperture means, said slide bar assembly comprising strip engaging means, a finger grip means extending from said strip engaging means through said slot and means on said cap body allowing a single strip to be dispensed from said housing while maintaining the remaining strips of said stack of testing strips in a moisture free environment.

* * * * *